US005894741A

United States Patent [19]

Durham et al.

[11] Patent Number: 5,894,741

[45] Date of Patent: Apr. 20, 1999

[54] UNIVERSAL HOUSING BODY FOR AN EXPANSION DEVICE HAVING A MOVABLE ORIFICE PISTON FOR METERING REFRIGERANT FLOW

[75] Inventors: Kenton L. Durham; Dean J. Groff, both of Siloam Springs, Ark.

[73] Assignee: Parker-Hannifin Corporation, Cleveland, Ohio

[21] Appl. No.: 09/065,204

[22] Filed: Apr. 23, 1998

[51] Int. Cl.[6] ..... F25B 41/04

[52] U.S. Cl. ..... 62/525; 62/527; 62/528; 137/533.17; 137/513.3; 137/493.8

[58] Field of Search ..... 62/527, 528, 525; 137/533.17, 493.8, 513.3

[56] References Cited

U.S. PATENT DOCUMENTS

| | | | |
|---|---|---|---|
| D. 341,409 | 11/1993 | Wiser . | |
| 3,877,248 | 4/1975 | Honnold, Jr. . | |
| 3,992,898 | 11/1976 | Duell et al. . | |
| 4,643,222 | 2/1987 | Wiser . | |
| 4,674,673 | 6/1987 | Parrish . | |
| 5,131,695 | 7/1992 | Wiser . | |
| 5,186,021 | 2/1993 | Keller | 62/511 |
| 5,341,656 | 8/1994 | Rust, Jr. et al. . | |
| 5,553,902 | 9/1996 | Powers . | |
| 5,564,754 | 10/1996 | Grenga . | |
| 5,695,225 | 12/1997 | Grenga . | |

OTHER PUBLICATIONS

Parker Hannifin Corporation, Byron Manufacturing Division catalog for "Byron Flo Raters Distributors Valves" published Sep., 1995.

The following references cited herein, having been published, known or used prior to the filing of the subject application are hereby admitted without prejudice to be prior art for the purpose of citation and consideration by the Examiner.

Product drawings of Carrier Corporation for Double Headed Design.

Pamphlet of Chatleff Controls.

Pamphlet of Spinco Metal Products, Inc., Brass Products Division.

Pamphlet of Byron Valve & Machine Co.

*Primary Examiner*—Henry Bennett
*Assistant Examiner*—Mark Shulman
*Attorney, Agent, or Firm*—John A. Molnar, Jr.

[57] ABSTRACT

A universal housing body for a refrigeration expansion device including a movable orifice piston. The body is adapted for interchangeable use with a piston of a first variety having a radial boss portion extending along a first axial distance, $L_1$, from a forward boss end having an annular sealing surface of a first maximum sealing diameter, $d_{max1}$, to a rearward boss end, and a piston of a second variety having a radial boss portion and an annular seal member having a forward surface defining with a rearward end of the boss portion a second axial distance, $L_2$, therebetween greater than the first axial distance $L_1$, and having a second minimum sealing diameter, $d_{min2}$, greater than $d_{min1}$ and less than $d_{max1}$. The housing body has an internal fluid passageway extending from a forward end to a rearward end which couplable with a flange end of an associated adapter. An annular valve seat, having an inner diametric extent, $d_i$, intermediate $d_{min2}$ and $d_{max1}$, is defined within the passageway such that a stop surface of the adapter is positionable within the passageway a spaced-apart distance from the valve seat to define a third axial distance, $L_3$, greater than $L_2$. The passageway is configured to receive the piston for movement between a forward and a rearward piston position, whereby in the forward position the sealing surface of the first variety piston and the forward surface of the second variety piston is disposed in an abutting, fluid-tight sealing engagement with the valve seal.

5 Claims, 4 Drawing Sheets

UNIVERSAL HOUSING BODY FOR AN EXPANSION DEVICE HAVING A MOVABLE ORIFICE PISTON FOR METERING REFRIGERANT FLOW

BACKGROUND OF THE INVENTION

The present invention relates broadly to orifice piston expansion devices for metering the flow of a refrigerant along two or more fluid flow paths within a refrigeration system such as between the condenser and evaporator coils of a heat pump or other reversible refrigeration cycle, and more particularly to a universal body for such device which is adapted to be interchangeable with existing pistons of a 3- or 5-fluted, gasketed variety, or of a double headed variety.

Air conditioning and other refrigeration systems are operated in a thermodynamic cycle which conventionally employs in series, as is shown at 10 in FIG. 1, a compressor, 12, a first heat exchanger or condenser, 14, an expansion function, represented at 16, and a second heat exchanger or evaporator, 18, all of which are arranged in a closed-loop circuit. Within such circuit 10, a refrigerant medium is cycled therethrough for its alternate conversion from a partially liquid to a partially gaseous state effecting a concomitant loss of heat.

When operated in a conventional cooling mode, energy is supplied into the thermodynamic cycle via the compressor 12 which is operated as having a low pressure inlet or suction side, 20, and a high pressure outlet or discharge side, 22. Within the compressor, the refrigerant is compressed and super-heated to exit the outlet side 22 thereof at a relatively high pressure. The refrigerant next is passed through the first heat exchanger 14 wherein a heat transfer is effected with a lower temperature fluid to remove the heat of compression from the refrigerant for its further cooling. From the first heat exchanger 14, the flow of the refrigerant, which is now in a liquefied and pressurized state, is regulated by the expansion function 16 and then is passed into the second heat exchanger 18. The refrigerant within the second heat exchanger 18 is volumetrically expanded with a state change from a high to a low pressure liquid, and subsequently a phase change to a low pressure gas. The specific and latent heats associated with the state and phase changes of the refrigerant effect the cooling of the area surrounding the second heat exchanger 18 or, with forced convective systems, of a higher temperature cooling medium such as air which is circulated in a heat transfer relationship with the heat exchanger. From the second heat exchanger 18, the refrigerant, now in a relatively low pressure gaseous phase, is returned to the suction side 20 of the compressor 12 wherein it is again compressed and thereafter cooled for the repetition of the cycle.

However, and as is detailed in U.S. Pat. Nos. 3,992,898 and 5,341,656, refrigeration systems of the above-described type also may be operated in an alternate thermodynamic or "heat pump" cycle to additionally heat the working environment. When operated in such mode, the duty of the two heat exchangers typically is reversed thermodynamically by physically reversing the direction of the flow of refrigerant through the system. In this regard, and as is shown at 30 in FIG. 1, a multi-position valve may be coupled in fluid communication with the suction and discharge sides of the compressor to selectively connect the heat exchangers to alternate sides of the compressor such that the first heat exchanger may be operated in a cooling or evaporator mode, with the second heat exchanger being operated in a heating or condenser mode.

As will be appreciated, to complete the thermodynamic reversal of the cycle, the refrigerant within circuit 10 must be throttled in the opposite direction through the expansion device. Therefore, the expansion function of such circuits conventionally may employ a double expansion device arrangement wherein a pair of expansion devices, referenced in FIG. 1 at 16*a–b*, are positioned in opposition within the supply line, 32, extending between heat exchangers 14 and 18. That is, devices 16*a–b* are arranged to throttle refrigerant in opposite directions. Expansion devices, which encompass capillary tubes, thermostatic expansions valves, and orifice piston-operated check valves, are further described in U.S. Pat. Nos. 5,695,225; 5,564,754; 5,553,902; 5,341,656; 5,131,695; 4,674,673; 4,643,222; 3,992,898; 3,877,248; 3,745,787; 3,120,743; and D341,409. Further, it is common practice to distribute the refrigerant discharged from each of the expansion devices 16 into a plurality of different circuit tubes, one of which is referenced at 34*a* for device 16*a*, and at 34*b* for device 16*b*, each of which is connected to a different section of the corresponding heat exchanger coil.

As is detailed in U.S. Pat. Nos. 3,992,898 and 5,341,656, a representative orifice piston expansion device of a "doubled headed" piston variety comprises an, elongate housing including a generally cylindrical internal chamber which extends intermediate a forward and a rearward end. The forward end terminates at axially rearwardly-facing raised ring which defines a generally annular, flat seating surface. The second end, in turn, terminates at a generally annular stop surface which may be presented from the leading edge of the forward or flange end of a union-type adapter. The other, rearward end of the adapter may be configured for a sweat or other connection with the interconnecting supply line which couples the paired expansion devices. Accordingly, in the circuit arrangement illustrated in FIG. 1, the forward chamber end may be coupled in fluid communication with the corresponding coil, with the rearward chamber end being coupled in fluid communication with the other expansion device.

A free-floating piston is received within the housing chamber to be slidably movable responsive to the direction of fluid flow from a first position disposed at the forward end of the chamber, to a second position disposed at the rearward end of the chamber. The piston, which extends intermediate truncated frusto-conical first end disposed confronting the forward chamber end and a truncated frusto-conical second end disposed confronting the rearward chamber end, is specially constructed as having a centrally-disposed, axial throughbore. The throughbore functions as a metering orifice to throttle refrigerant flowing into the corresponding coil. The piston further is formed a having an enlarged diameter boss portion extending intermediate the first and second ends thereof. The boss portion has a forward end defining a generally annular sealing surface configured for an abutting, fluid-tight engagement with the seating surface of the forward chamber end, and a rearward end. The boss portion is further configured to define a plurality of spaced-apart fins, each having a pair of opposing lateral surfaces and extending radially-outwardly from the boss portion. Each of the fins further extends axially along the boss portion from a forward end to a rearward end which is abuttingly engagable with the stop surface disposed at the rearward chamber end for delimiting the travel of the piston in the rearward direction. The lateral surfaces of the fins each defines a peripheral fluid passageway with an opposing lateral surface of an adjacent fin and the interior surface of the chamber.

In operation, with refrigerant flowing in a forward direction through the device, the piston is advanced responsive to fluid pressure to a first position wherein the boss seating surface is disposed in abutting, fluid-tight contact with the chamber seating surface. With the piston being disposed in such first position, the entirety of the refrigerant flow is throttled through the metering orifice. When the refrigerant flow is reversed, the piston is advanced responsive to reverse fluid pressure to a second position wherein the rearward ends of the fins are disposed in an abutting engagement with the chamber stop surface. With the piston being disposed in such first position, a lower pressure drop refrigerant flow is vented through the peripheral passageways.

Representative orifice piston expansion devices of a gasketed piston variety are detailed in U.S. Pat. Nos. 5,695,225; 5,564,754; and 4,643,222. Such devices operate similarly to the double headed piston devices described hereinbefore, with the exception that in the first or forward position of the piston, the fluid tight seal between the piston forward end and the chamber seating surface is effected by way of a compressible seal ring. In this regard, an annular groove or gland is integrally-formed about the forward end of the piston. The gland is configured to receive an o-ring, rectangular cross-section, or other gasket seal which may be formed of a fluoropolymer material such as polytetrafluoroethylene (PTFE) or a synthetic rubber material such as a neoprene. The seal is mounted within the gland such that a forwardly-presented axial surface thereof defines the sealing surface of the piston for abutting contact with the chamber seating surface. Gasketed piston are commercially provided as having either 3 or 5 fins and a to define a corresponding number of peripheral passageways or "fluted" channels.

Orifice pistons of the above-described double headed and gasketed varieties are manufactured commercially by the Byron Manufacturing Division of Parker-Hannifin Corporation (Siloam Springs, Ariz.), by Chatleff Controls, Inc. (Buda, Tex.), and by Spinco Metal Products, Inc. (Newark, N.J.). Refrigeration system manufacturers include Carrier Corporation (Syracuse, N.Y.), Rheem Manufacturing Co. (Fort Smith, Ariz.), and Trane Co. (La Crosse, Wis).

With respect to component manufacturers, the type and configuration of the expansion device, whether as original equipment or for replacement parts, typically are specified by the systems manufacturer. Accordingly, component manufacturers and their distributors heretofore had to maintain stocks of different device varieties to satisfy customer requirements. Particularly with respect to expansion devices of the orifice piston variety, however, the need to maintain separate stocks of housing body components for accommodating the different varieties of pistons such as double headed and gasketed varieties represented a significant inventory expense. That is, it is known that body styles adapted for use with fluted pistons are not functional with pistons of a double headed construction, and vice versa.

Moreover, the forward end of the housing body typically is configured to receive a plurality of circuit tubes for connection to the associated coil. These tubes typically are brazed or otherwise welded to the coil, which then is supplied with the housing body as an integral unit. At least two separate stocks of these coil and body units therefore had to be maintained depending upon whether the particular application involved a device utilizing a gasketed or a double headed piston design.

In view of the foregoing, it is apparent that continued improvements in expansion devices for heat pump and other refrigeration circuits would be well-received by industry. A preferred orifice piston device construction would decrease inventory costs and the need to maintain separate body designs for different types of pistons while continuing to maintain proper operation of the refrigeration system.

SUMMARY OF THE INVENTION

The present invention is directed to universal housing body for orifice piston expansion devices which is adapted to be interchangeable with existing pistons of a 3- or 5-fluted gasketed-variety or of a double headed variety. In having an internal chamber which is configured to receive and seal pistons of either variety, the housing of the present invention therefore may be used with either variety. Therefore, only a single body style need be manufactured and component distributors may dispense with the need to stock multiple coil assemblies for use within different refrigeration systems.

It is, therefore, a feature of a disclosed embodiment of the present invention to provide a universal housing for an expansion device of a refrigeration system wherein a working fluid is circulated under pressure. The device is of a type which includes an adapter having a forward flange end terminating at a generally annular stop surface and a piston which extends axially intermediate a generally frustoconical forward piston end and a rearward piston end. The piston further has an throughbore formed axially therethrough defining a first fluid flow path within the device and an outer periphery with a plurality of axially-aligned channels defining a second fluid flow path within the device. Within the housing, the piston is movable responsive to fluid pressure between a forward position closing the second fluid flow path to throttle fluid flow in a first direction through the first fluid flow path, and a rearward position admitting an unregulated fluid flow in a second direction through the first and the second fluid flow path.

The housing is adapted for use with one such piston of a first variety having a radial boss portion extending intermediate the forward and rearward piston ends. The boss portion extends from a forward boss end having a vertically disposed, annular sealing surface of a given first minimum sealing diameter, $d_{min1}$, and a given first maximum sealing diameter, $d_{max1}$, to a rearward boss end a given first axial distance, $L_1$, with the forward boss end.

In accordance with the precepts of the present invention, the housing further is adapted for use, interchangeably, with another such piston of a second variety having a radial boss portion extending from a forward boss end disposed intermediate the forward and rearward piston ends to a rearward boss end. Such piston additionally has an annular seal member mounted within a circumscribing groove formed intermediate the forward piston end and the forward boss end. The seal member has a forward surface defining with the rearward boss end a given second axial distance, $L_2$, therebetween greater than the first axial distance $L_1$. The seal member forward surface also defines a given second minimum sealing diameter, $d_{min2}$, greater than the first minimum sealing diameter $d_{min1}$ and less than the first maximum sealing diameter $d_{max1}$, and a given second maximum sealing diameter, $d_{max2}$.

In basic construction, the housing is formed as a generally cylindrical body having an internal fluid passageway formed therein extending along a longitudinal axis from a forward passageway end to an open rearward passageway end couplable with the forward flange end of the adapter to position the stop surface thereof within the passageway. An annular valve seat is defined within the passageway intermediate the forward and rearward ends thereof such that the adapter stop surface is positionable within the passageway an axially spaced-apart distance from the valve seat defining a third axial distance, $L_3$, greater than the second axial distance $L_2$. The valve seat has an inner diametric extent, $d_i$, intermediate the second minimum sealing diameter $d_{min2}$ and the first maximum sealing diameter $d_{max1}$.

The passageway is configured intermediate the rearward end thereof and the valve seat to operably receive the piston for sliding movement along the longitudinal axis between the forward position and the rearward position. In this regard, in the forward position the forward boss end sealing surface of the piston of the first variety and the seal member forward surface of the piston of the second variety is disposed in an abutting, fluid-tight sealing engagement with the valve seat. In the second position, the rearward boss end of the piston of the first variety and the rearward boss end of the piston of the second variety is disposed in an abutting engagement with the stop surface of the adapter forward flange end.

In a preferred embodiment, the valve seat of the housing body is configured as a rearwardly-facing, generally vertically-disposed land surface. In the forward position, the forward boss end sealing surface of the piston of said first variety and the seal member forward surface of said piston of said second variety therefore is disposed in an abutting, fluid-tight sealing engagement with the land surface. Additionally in the preferred embodiment, the first axial distance $L_1$ of the piston of said first variety is sized to be between about 0.24–0.26 inch (6.6–6.1 mm), with the second axial distance $L_2$ of said piston of said second variety being between about 0.40–0.43 inch (10.2–10.9 mm), and the third axial distance $L_3$ of said passageway of said housing body being about 0.52 inch (13.2 mm). Likewise, the second minimum sealing diameter $d_{min2}$ of said piston of said second variety may be between about 0.260–0.265 inch (6.6–6.73 mm), with the first maximum sealing diameter $d_{max1}$ of said piston of said first variety being between about 0.346–0.351 inch (8.78–8.92 mm), and the inner diametric extent $d_i$ of said annular valve seat of said housing body being between about 0.272–0.281 inch (6.88–7.14 mm).

Advantages of the present invention include a housing body construction for orifice piston expansion devices which is economical to manufacture and which is universal in being adapted to be interchangeable with conventional piston designs of a 3- or 5-fluted gasket-variety or of a double headed variety. Additional advantages include a retrofittable housing body construction which is interchangeable with existing pistons for use in conjunction with conventional adapter bodies and circuit tubes. These and other advantages will be readily apparent to those skilled in the art based upon the disclosure contained herein.

BRIEF DESCRIPTION OF THE DRAWINGS

For a fuller understanding of the nature and objects of the invention, reference should be had to the following detailed description taken in connection with the accompanying drawings wherein.

Figure 1:
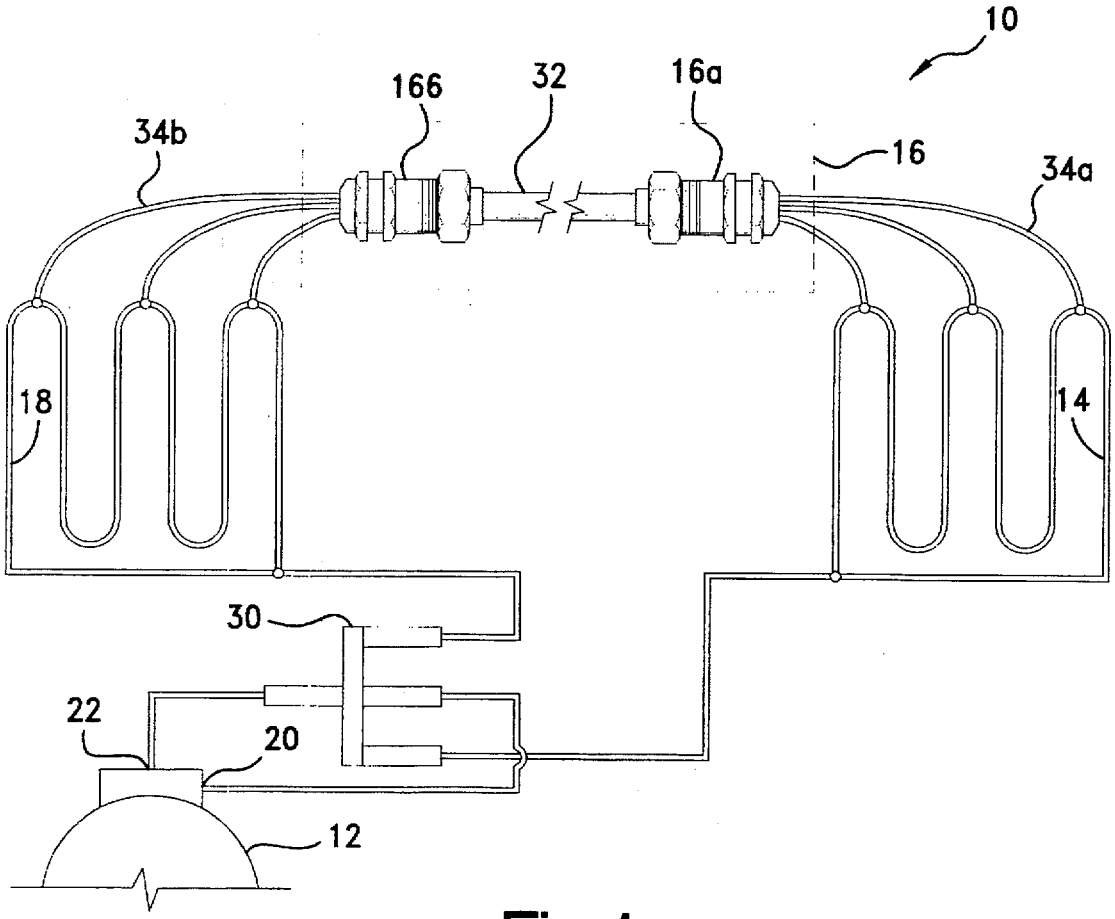
FIG. 1 is schematic fluid flow diagram showing a representative refrigeration circuit which may be operated in a reversible thermodynamic cycles to provide alternate heating and cooling modes.

The drawings will be described further in connection with the following Detailed Description of the Invention.

DETAILED DESCRIPTION OF THE INVENTION

Certain terminology may be employed in the description to follow for convenience rather than for any limiting purpose. For example, the terms "upper" and "lower" designate directions in the drawings to which reference is made, with the terms "inner" or "interior" and "outer" or "exterior" referring, respectively, to directions toward and away from the center of the referenced element, and the terms "radial" and "axial" referring, respectively, to directions perpendicular and parallel to the longitudinal central axis of the referenced element. Terminology of similar import other than the words specifically mentioned above likewise is to be considered as being used for purposes of convenience rather than in any limiting sense.

For the purposes of the discourse to follow, the precepts of the universal housing body of the invention herein involved are described in connection with its utilization within an expansion device or pair of devices for a reversible refrigeration system such as the "heat pump" circuit shown in FIG. 1. It will be appreciated, however, that aspects of the present invention may find application in expansion devices used within other refrigeration circuits. Use within those such other applications therefore should be considered to be expressly within the scope of the present invention.

Figure 2:
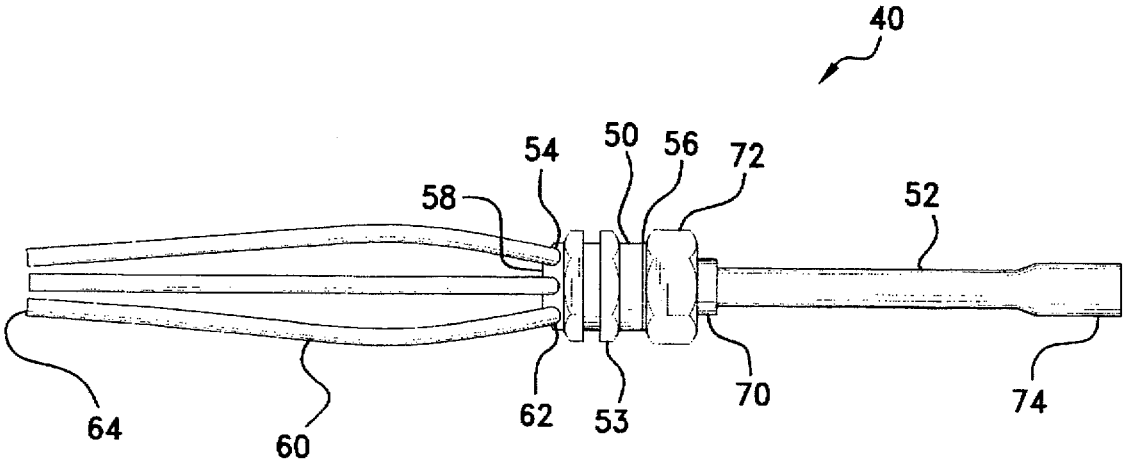
FIG. 2 is a side elevational assembly view of a orifice piston expansion device including a universal housing body in accordance with the present invention and as particularly adapted for use in the reversible refrigeration circuit of FIG. 1.

Referring then to the figures wherein corresponding reference numbers are used to designate corresponding elements throughout the several views with equivalent elements being referenced with prime designations, an orifice piston expansion device of the type herein involved is shown generally at 40 in FIG. 2 as including the universal housing body of the present invention, 50, and an associated adapter, 52. Body 50, which may be configured as having a hexagonal flats section, 53, for engagement with a wrench or the like, extends intermediate a forward distribution end, 54, and a rearward coupling end, 56. In the embodiment shown, forward end 54 is provided to terminate at an angled nozzle face, 58, with rearward coupling end being externally threaded for connection to adapter 52. Although nozzle face 58 may define a single port opening admitting refrigerant flow through device 40, it is preferred that face 58 be configure to define a multiplicity of port openings, one of which may be seen in phantom at 59 with momentary reference to FIGS. 6 and 7. Within each of openings 59 is received a corresponding distribution conduit, one of which is designated at 60. Each of conduits 60, which typically are formed of copper tubing or the like, extend from a proximal end, 62, which may be brazed or otherwise joined to a corresponding port opening formed within face 58, to a distal end, 64, provided for a brazed or other connection to, with reference again to FIG. 1, a section of the corresponding heat exchanger coil 14 or 18 for the distribution of refrigerant fluid thereto.

Adapter 52 is conventionally provided as having a forward flange end, 70, over which is received an internally-threaded nut or other fastening member, 72, for a threaded connection with the coupling end 56 of body 50, and a rearward socket end, 74, configured for a brazed, soldered, sweat, or other connection with a tube, conduit, or other line such as supply 32 of FIG. 1. In this regard, for the application illustrated in FIG. 1, a pair of devices 40 may be coupled in series, as at 16*a–b*, but as operatively reversed to, depending upon the direction of fluid flow through circuit 10, alternately regulate refrigerant flow into heat exchangers 14 and 18. That is, in the event heat exchanger 18 is operated in an evaporator mode, device 16*a* is oriented to admit refrigerant freely from heat exchanger 14 to device 16*b* which, in turn, is oriented to throttle the same into heat exchanger 18. In the event that heat exchanger 18 alternatively is operated in a condensing mode, device 16*b* is oriented to admit refrigerant freely from heat exchanger 18 to device 16*a* which, in turn, is oriented to throttle the same into heat exchanger 14.

Although adapter 52 is shown for illustrative purposes to be straight, angled runs also should be considered within the scope of the invention herein involved. Likewise, although rearward coupling end 56 of body 50 and forward flange end 70 of adapter 52 are shown to be configured for, respectively, a threaded male to female coupling connection, it will be appreciated that other means may be utilized such as a threaded female to male coupling arrangement, as well as welded joint arrangements. Looking momentarily to the cross-sectional views of FIGS. 6 and 7, it may be seen that in the illustrated arrangement, a fluid-tight connection between body 50 and adapter 52 conventionally may be effected via a PTFE or other seal ring, 80, which is interposed therebetween. In this regard, a circumferential gland, 82, may be defined about the forward flange end 70 of adapter 52 within which seal ring 80 may be seated for compression intermediate groove 82 and a leading edge, 84, of the rearward coupling end 56 of housing body 50. That is, as nut 72 is threadably engaged with the rearward coupling end 56 of housing body 50, adapter 52 is drawn coaxially toward housing body 50 urging the leading edge 84 thereof into gland 82. As further may be seen in FIGS. 6 and 7, an optional screen or other in-line filter member, 86, may be mounted within the adapter 52 as internally received within the forward flange end 70 thereof for separating particulate contaminates from the refrigerant flow.

In an alternative embodiment which is described further in U.S. Pat. No. 5,131,695, gland 82 may be formed within the rearward coupling end of housing body 50. In such arrangement, with seal ring 80 seated within such gland, an associated leading edge of the adapter forward flange end 70 may be urged thereinto for the fluid-tight compression of the seal ring as nut 72 is threadably engaged with the rearward coupling end 56 of housing body 50.

For metering the flow of refrigerant through device 40, an orifice piston is received internally within housing body 50. In accordance with the precepts of the present invention, housing body 50 is adapted for use with a conventional piston of a first conventional variety, a representative one of which is shown generally at 90 in FIGS. 3A and 3B, and, interchangeably, with a conventional piston of a second variety, a representative one of which is shown generally at 100 in FIGS. 4A and 4B. An alternative embodiment of piston 100 of the second variety is shown generally at 100' in FIGS. 5A and 5B. Looking collectively then to FIGS. 3, 4, and 5, all of the pistons may be seen as extending axially intermediate a generally frusto-conical forward piston end, 102, and a rearward piston end, 104, and as having an axial throughbore, 106, which may be cylindrical, counterbored, or tapered, formed therethrough. Within expansion device 40, throughbore 106 functions as a metering orifice in defining a first fluid flow path through device 40, and therefore is sized according to system specifications to effect a select pressure drop within the refrigerant flow. Pistons 90, 100, and 100' each further are formed as having a outer periphery, 108, with a plurality of axially aligned channels or flutes, one of which is referenced at 110, defining a second fluid flow path within device 40. As interchangeably received within housing body 50, each of the pistons is slidably movable responsive to fluid pressure between a forward position closing the second flow path to throttle or otherwise regulate fluid flow in a first direction though the metering orifice, and a rearward position admitting an unregulated fluid flow in a second direction through the first and second fluid flow paths.

Figure 3A:
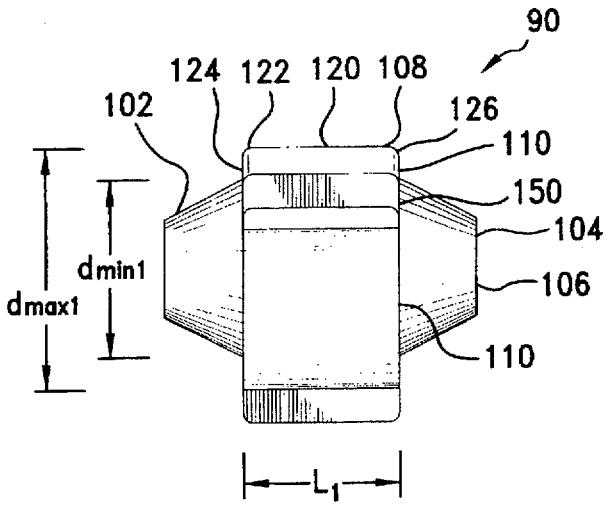
FIG. 3A is an enlarged side elevational view of a representative double headed-variety orifice piston for use with the universal housing body of FIG. 2.
Figure 3B:
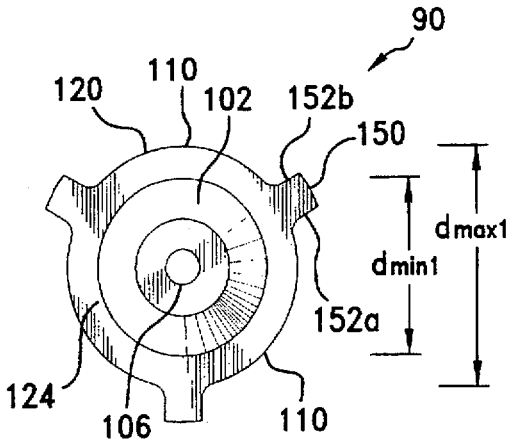
FIG. 3B is a front view of the orifice piston of FIG. 3A.
Figure 4A:
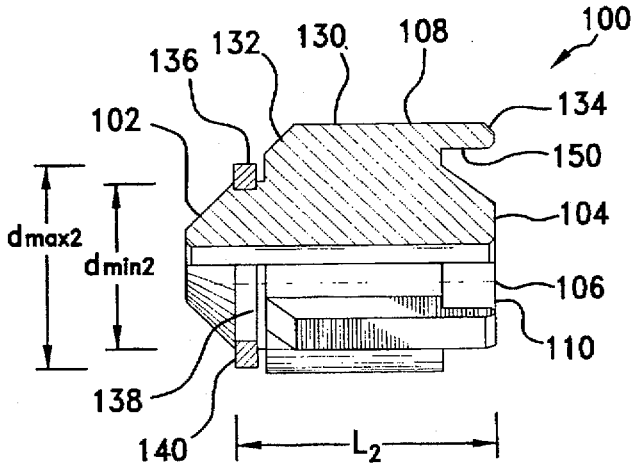
FIG. 4A is an enlarged side elevational view shown in partial cross-section of a representative 3-fluted, gasketed-variety orifice piston for use with the universal housing body of FIG. 2.
Figure 4B:
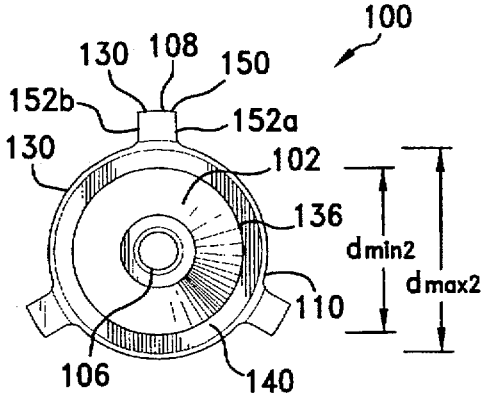
FIG. 4B is a front view of the orifice piston of FIG. 4A.

Referring next particularly to FIGS. 3A and 3B, piston 90 of the first variety may be seen to include a radial boss portion, 120. Boss portion 120 extends intermediate the forward and rearward piston ends 102 and 104 from a forward boss end, 122, having a vertically disposed, annular sealing surface, 124, of a given first minimum sealing diameter, $d_{min1}$, and a given first maximum sealing diameter, $d_{max1}$, to a rearward boss end, 126, defining a given first axial distance, $L_1$, with the forward boss end. As to piston 100 of the second variety, such piston may be seen in FIGS. 4A and 4B to be formed as having a radial boss portion, 130, extending from a forward boss end, 132, disposed intermediate the forward and rearward piston ends to a rearward boss end, 134.

For sealing the second fluid flow path, piston 100 additionally includes a separate seal member, 136, which is mounted within an annular circumscribing gland, 138, formed intermediate the forward piston end 102 and the forward boss end 132. Seal member 136, which typically is either a neoprene or other synthetic rubber O-ring or, as is shown, an annular PTFE gasket having a generally rectangular cross-section, is provided as having a forward surface, 140, defining with the rearward boss end 134 a given second axial distance, $L_2$, therebetween which is dimensioned greater than the first axial distance $L_1$ of piston 90. As seated within gland 138, seal member 136 additionally is dimensioned as defining a given second minimum sealing diameter, $d_{min2}$, and a given second maximum sealing diameter, $d_{max2}$, which is the outer diameter (O.D.) of the seal. Relative to piston 90, it was recognized that the second minimum sealing diameter $d_{min2}$ of piston 100 is greater than the first minimum sealing diameter $d_{min1}$ of piston 90, but is less than the first maximum sealing diameter $d_{max1}$ thereof.

For most commercial applications, the O.D. and, accordingly, the second maximum sealing diameter $d_{max2}$ of seal member 136 will be between about 0.32–0.33 inch (8.2–8.4 mm). Depending upon the configuration of the seal member, gland 138 may be provided as having the semi-rectangular profile shown or, alternatively, a semi-circular profile adapted to receive an O-ring-type seal. Each of such profiles typically have a depth of between about 0.023–0.039 inch (0.58–0.99 mm) top accommodate the inner diameter (I.D.) of the seal member 136 which typically will be between about 0.215–0.220 inch (5.5–5.6 mm).

Figure 5A:
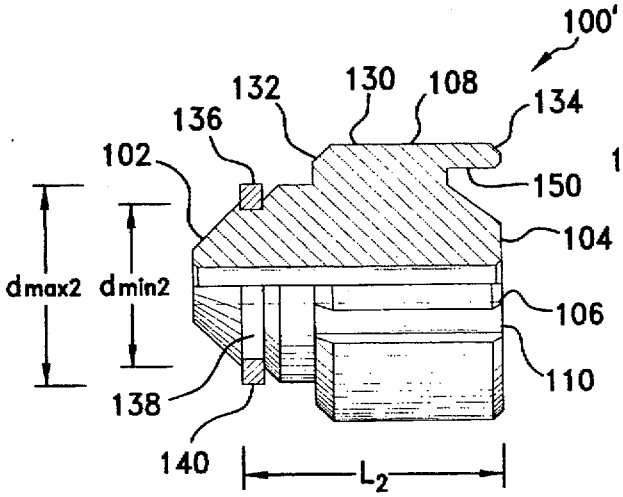
FIG. 5A is an enlarged side elevational view shown in partial cross-section of a representative 5-fluted, gasketed-variety orifice piston for use with the universal housing body of FIG. 2.
Figure 5B:
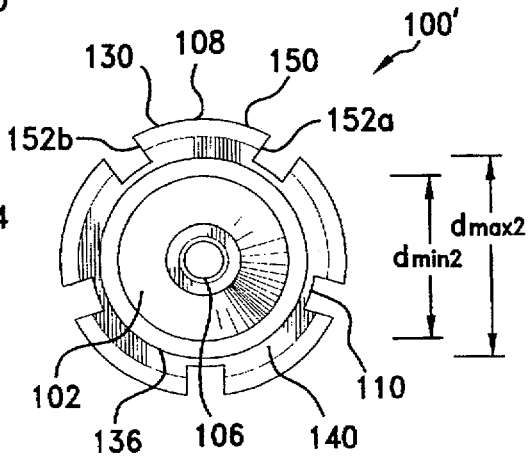
FIG. 5B is a front view of the orifice piston of FIG. 5A.

As to piston 100', it may be seen with reference to FIGS. 5A and 5B that such piston is dimensioned similarly to piston 100 in pertinent respect, but as having five radially-spaced apart channels 108 as compared to the three channels 108 for piston 100. In this regard, each of the boss portions of pistons 90, 100, and 100' may be considered as defining a plurality of radially spaced-apart "fins," one of which is referenced at 150, in the front views of FIGS. 3B, 4B, and 5B. Each of fins 150 has a pair of opposing lateral surfaces, 152*a–b*, each of which surfaces which defines a channel 110 with an opposing lateral surface of an adjacent fin. Overall, pistons 90, 100, and 100' were recognized to have about the same "envelope" with respect to overall length, typically between about 0.47–0.51 inch (12–13 mm) and diameter, typically between about 0.4575–0.4585 inch (11.62–11.64 mm).

Turing next to FIGS. 6 and 7, simplified cross-sectional assembly views of device 40 of FIG. 2 are shown at 200 in FIG. 6 as used in conjunction with piston 90 of FIG. 3, and at 200' in FIG. 7 as used, interchangeably, with piston 100 of FIG. 4. In internal construction, housing body 50 of the present invention is constructed as having a central fluid passageway, 202, provided therein. Passageway 202 extends along a central longitudinal axis, 204, from a forward passageway end, 206, to an open rearward passageway end, 208, which is couplable with the adapter flange end 70 to coaxially receive a terminal stop surface, 210, thereof, at a fixed position within passageway 202. The forward passageway end 206 is coupled in fluid communication with each of port opening 59 via associated ducts, one of which is referenced at 212.

For effecting a fluid tight seal with the piston in its forward position (FIGS. 6B and 7B), an annular valve seat, 220, is defined within passageway 202 intermediate the forward and rearward ends 206 and 208. Valve seat 220 is positioned within passageway 202 relative to adapter stop surface 210 to define a third axial distance, referenced at $L_3$, therebetween which is greater that the second axial distance $L_2$ of piston 100. Advantageously, such positioning accommodates the travel of both piston 90 and piston 100 intermediate their forward and rearward positions. Valve seat 220 further is positioned within passageway 202 to define an inner diametric extent, $d_i$, which is sized intermediate the second minimum sealing diameter $d_{min2}$ of piston 100 and the first maximum sealing diameter $d_{max1}$ of piston 90.

To accommodate the receipt of piston 90, 100, or 100' therein, passageway 202 is configured intermediate the rearward end 208 thereof and valve seat 220 to define a chamber, 230, of an enlarged diametric extent. With pistons 90, 100, and 100' individually having an outer of between about 0.4575–0.4585 inch (11.62–11.64 mm), the inner diameter of chamber 230 may be sized correspondingly as being between about 0.459–0.462 inch (11.66–11.73 mm).

Figure 6A:
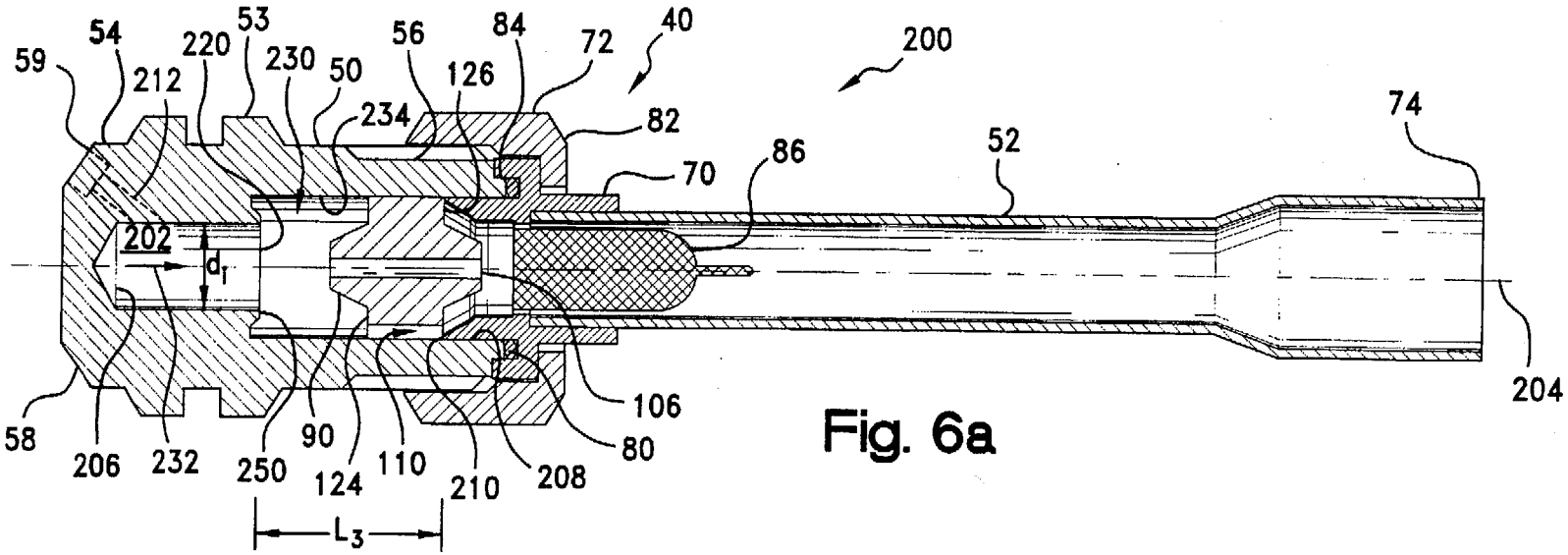
FIG. 6A is a cross-sectional operational view showing the expansion device of FIG. 2 as including the representative double headed-variety orifice piston of FIG. 3 which is disposed in a rearward position within the housing.
Figure 6B:
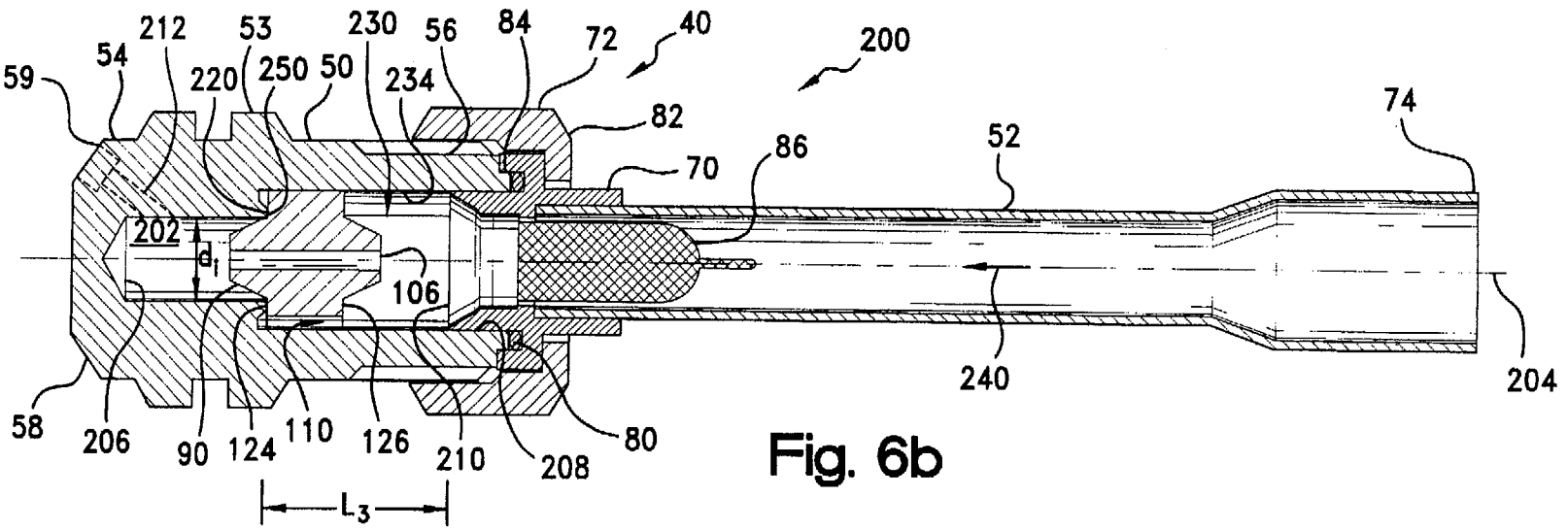
FIG. 6B is a cross-sectional view of the expansion device of FIG. 6A showing the orifice piston thereof disposed in a forward position within the housing.
Figure 7A:
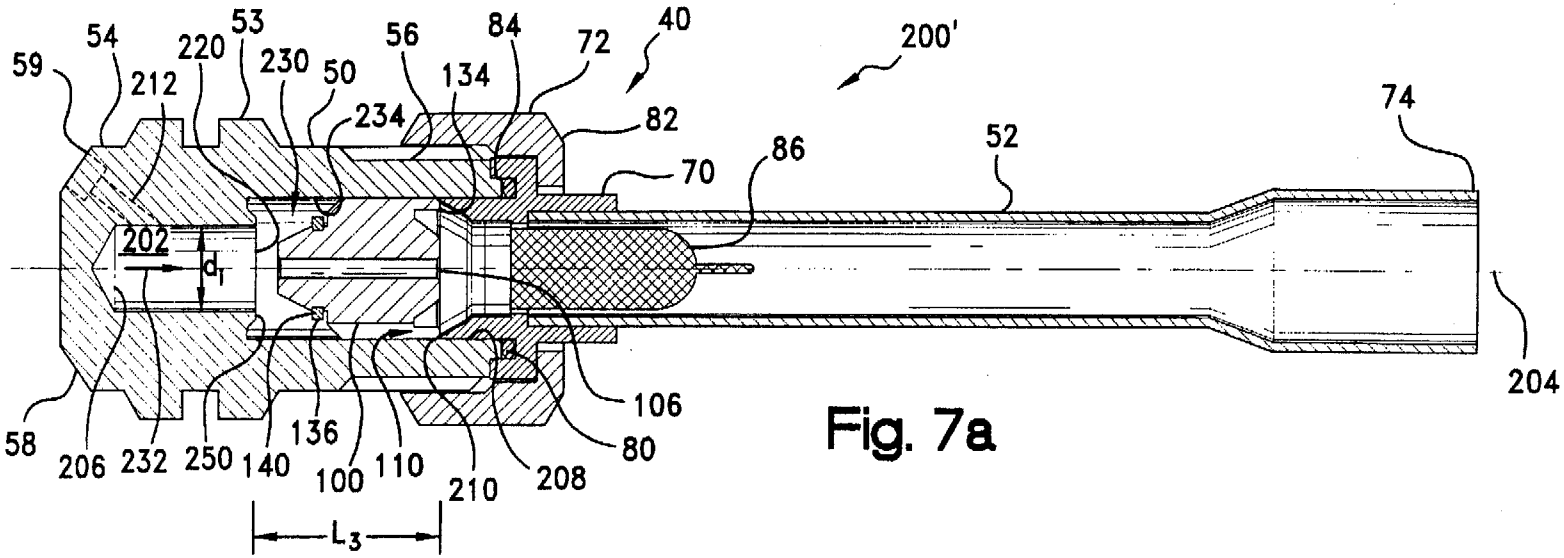
FIG. 7A is a cross-sectional operational view showing the expansion device of FIG. 2 as including the representative gasketed-variety orifice piston of FIG. 4 which is disposed in a rearward position within the housing.
Figure 7B:
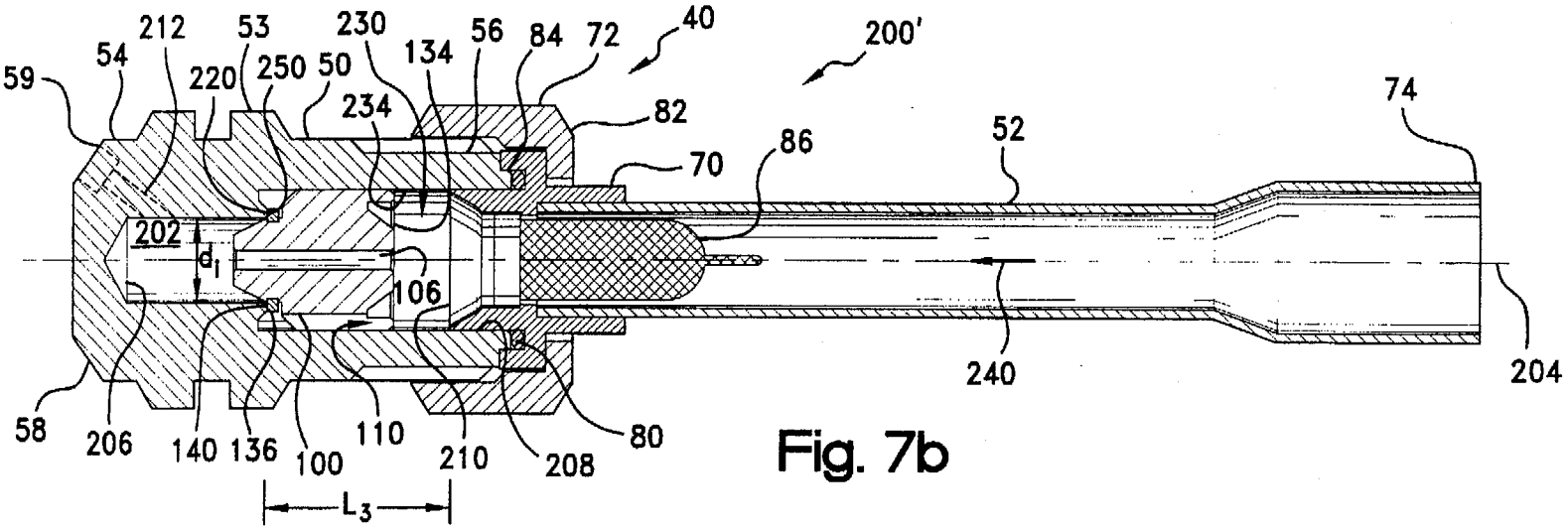
FIG. 7B is a cross-sectional view of the expansion device of FIG. 7A showing the orifice piston thereof disposed in a forward position within the housing.

Within chamber 230, either of pistons may be operably received for sliding movement between the forward position shown in FIG. 6B for piston 90 and in FIG. 7B for piston 100, and the rearward positions shown in FIGS. 6A and 7A. That is, in service, each of the pistons is movable within chamber responsive to the direction of fluid pressure or flow. With fluid flow being provided in the direction referenced at 232 in FIGS. 6A and 7A, the rearward boss end 126 of piston 90 (FIG. 6A), and the rearward boss end 134 of piston 100 (FIG. 7A) and piston 100' each is disposed in an abutting, travel delimiting engagement with the stop surface 210 of the adapter forward flange end 70. In such position, and as aforementioned, an unregulated fluid flow is admitted in the direction of arrow 232 through the piston metering orifice throughbore 106 and the piston channels 110 which define openings with the generally cylindrical inner surface, 234, of chamber 230. Alternatively, with fluid flow being provided in the direction referenced at 240 in FIGS. 6B and 7B, the forward boss end sealing surface 124 of piston 90 (FIG. 6B), and the seal member forward surface 140 of said piston 100 (FIG. 7B) and piston 100' each is disposed in an abutting, fluid-tight sealing engagement with the valve seat 220 closing the second fluid path through pistons channels 110 and throttling or otherwise metering the fluid flow in the direction of arrow 240 through the piston metering orifice throughbore 106. Advantageously, the sizing of valve seat 220 is able to accommodate the fluid-tight sealing of either the described double headed or gasketed-variety pistons.

In a preferred embodiment, and as is shown in FIGS. 6 and 7, valve seat 220 is configured as a rearwardly-facing, generally vertically-disposed land surface, 250. Unexpectedly, it has been observed that such configuration is adapted to effect a fluid-tight seal in the piston forward position with both the forward boss end sealing surface 124 of piston 90 (FIG. 6B), and the seal member forward surface 140 of said piston 100 (FIG. 7B) and piston 100'.

For most commercial applications, the first axial distance $L_1$ of piston 90 will between about 0.24–0.26 inch (6.6–6.1 mm), with the second axial distance $L_2$ of pistons 100 and 100' being between about 0.40–0.43 inch (10.2–10.9 mm). Accordingly, the third axial distance $L_3$ of the housing body passageway 202 will be selected to be about 0.52 inch (13.2 mm). Further in such applications, with the second minimum sealing diameter $d_{min2}$ of pistons 100 and 100' being between about 0.260–0.265 inch (6.6–6.73 mm), and the first maximum sealing diameter $d_{max1}$ of piston 90 being between about 0.346–0.351 inch (8.78–8.92 mm), the inner diametric extent $d_i$ of the housing body valve seat 220 will be selected to be between about 0.272–0.281 inch (6.88–7.14 mm). Of course, the inner diametric extent $d_i$ additionally is selected to be greater than the first minimum sealing diameter $d_{min1}$, which typically will be between about 0.236–0.246 inch (5.99–6.25 mm), and to be less than the second maximum sealing diameter $d_{max2}$ of between about 0.32–0.33 inch (8.2–8.4 mm).

Thus, a unique housing body construction for an orifice piston expansion device is described which accommodates the interchangeable use of conventional pistons of different commercial types, and which may be used with adapter bodies of conventional design.

Materials of construction suitable for the housing body of the present invention are to be considered conventional for the uses involved. Such materials generally will be corrosion resistant, but particularly will depend upon the fluid or fluids being handled. Aluminum, mild or stainless steel, copper, and brass are preferred for reasons of cost and ease of manufacturing using conventional machining techniques. Other types of metals and even plastic materials and composites may be substituted, however, but also as selected for compatibility with the fluid being transferred or for desired mechanical properties. With respect to the orifice piston, adapter, and other components of the device, metal materials such as aluminum, mild or stainless steel, copper, and brass again are considered preferred.

As it is anticipated that certain changes may be made in the present invention without departing from the precepts herein involved, it is intended that all matter contained in the foregoing description shall be interpreted in as illustrative rather than in a limiting sense. All references cited herein are expressly incorporated by reference.

What is claimed is:

1. A universal housing for an expansion device of a refrigeration system wherein a working fluid is circulated under pressure, the device including an adapter having a forward flange end terminating at a generally annular stop surface and a piston which extends axially intermediate a generally frusto-conical forward piston end and a rearward piston end and which has an throughbore formed axially therethrough defining a first fluid flow path within said device and an outer periphery with a plurality of axially-aligned channels defining a second fluid flow path within said device, said piston being movable within said housing responsive to fluid pressure between a forward position closing said second fluid flow path to throttle fluid flow in a first direction through said first fluid flow path, and a rearward position admitting an unregulated fluid flow in a second direction through said first and said second fluid flow path, said housing being adapted for use with a said piston of a first variety having a radial boss portion extending intermediate the forward and rearward piston ends from a forward boss end having a vertically disposed, annular sealing surface of a given first minimum sealing diameter, $d_{min1}$, and a given first maximum sealing diameter, $d_{max1}$, to a rearward boss end defining a given first axial distance, $L_1$, with the forward boss end, and said housing being adapted for use, interchangeably, with a said piston of a second variety having a radial boss portion extending from a forward boss end disposed intermediate the forward and rearward piston ends to a rearward boss end, and having an annular seal member mounted within a circumscribing gland formed intermediate the forward piston end and the forward boss end, said seal member having a forward surface defining with the rearward boss end a given second axial distance, $L_2$, therebetween greater than said first axial distance $L_1$, and defining a given second minimum sealing diameter, $d_{min2}$, greater than said first minimum sealing diameter $d_{min1}$ and less than said first maximum sealing diameter $d_{max1}$, and a given second maximum sealing diameter, $d_{max2}$, said housing comprising:

a generally cylindrical body having an internal fluid passageway formed therein extending along a longitudinal axis from a forward passageway end to an open rearward passageway end couplable with the forward flange end of the adapter to position the stop surface thereof within said passageway;

an annular valve seat defined within said passageway intermediate the forward and rearward ends thereof such that the adapter stop surface is positionable within said passageway an axially spaced-apart distance from said valve seat defining a third axial distance, $L_3$, greater than said second axial distance $L_2$, said valve seat having an inner diametric extent, $d_i$, intermediate said second minimum sealing diameter $d_{min2}$ and said first maximum sealing diameter $d_{max1}$, said passageway being configured intermediate the rearward end thereof and said valve seat to operably receive said piston for sliding movement along said longitudinal axis between said forward position and said rearward position, whereby in said forward position the forward boss end sealing surface of said piston of said first variety and the seal member forward surface of said piston of said second variety is disposed in an abutting, fluid-tight sealing engagement with the valve seat, and whereby in said second position the rearward boss end of said piston of said first variety and the rearward boss end of said piston of said second variety is disposed in an abutting engagement with the stop surface of the adapter forward flange end.

2. The housing of claim 1 wherein the first axial distance $L_1$ of said piston of said first variety is between about 0.24–0.26 inch (6.6–6.1 mm), the second axial distance $L_2$ of said piston of said second variety is between about 0.40–0.43 inch (10.2–10.9 mm), and the third axial distance $L_3$ of said passageway of said housing body is about 0.52 inch (13.2 mm).

3. The housing of claim 2 wherein the second minimum sealing diameter $d_{min2}$ of said piston of said second variety is between about 0.260–0.265 inch (6.6–6.73 mm), the first maximum sealing diameter $d_{max1}$ of said piston of said first variety is between about 0.346–0.351 inch (8.78–8.92 mm), and the inner diametric extent $d_i$ of said annular valve seat of said housing body is between about 0.272–0.281 inch (6.88–7.14 mm).

4. The housing of claim 1 wherein the second minimum sealing diameter $d_{min2}$ of said piston of said second variety is between about 0.260–0.265 inch (6.6–6.73 mm), the first maximum sealing diameter $d_{max1}$ of said piston of said first variety is between about 0.346–0.351 inch (8.78–8.92 mm), and the inner diametric extent $d_i$ of said valve seat of said housing body is between about 0.272–0.281 inch (6.88–7.14 mm).

5. The housing of claim 1 wherein said valve seat of said housing body is configured as a rearwardly-facing, generally vertically-disposed land surface such that in said forward position the forward boss end sealing surface of said piston of said first variety and the seal member forward surface of said piston of said second variety is disposed in an abutting, fluid-tight sealing engagement with said land surface.

* * * * *